US011090942B2

(12) United States Patent
Gardner et al.

(10) Patent No.: US 11,090,942 B2
(45) Date of Patent: Aug. 17, 2021

(54) FLUID EJECTION DIES INCLUDING STRAIN GAUGE SENSORS

(71) Applicant: HEWLETT-PACKARD DEVELOPMENT COMPANY, L.P., Spring, TX (US)

(72) Inventors: James Gardner, Corvallis, OR (US); Berkeley Fisher, Corvallis, OR (US); Andrew Koll, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 35 days.

(21) Appl. No.: 16/486,930

(22) PCT Filed: Apr. 24, 2017

(86) PCT No.: PCT/US2017/029105

§ 371 (c)(1),
(2) Date: Aug. 19, 2019

(87) PCT Pub. No.: WO2018/199886

PCT Pub. Date: Nov. 1, 2018

(65) Prior Publication Data

US 2021/0129540 A1 May 6, 2021

(51) Int. Cl.
*B41J 2/165* (2006.01)

(52) U.S. Cl.
CPC ..... *B41J 2/16579* (2013.01); *B41J 2/16517* (2013.01); *B41J 2002/16573* (2013.01); *B41P 2235/20* (2013.01)

(58) Field of Classification Search
CPC ..... B41J 2/16579; B41J 2/16517
See application file for complete search history.

(56) References Cited

U.S. PATENT DOCUMENTS

| | | | | |
|---|---|---|---|---|
| 6,022,093 | A * | 2/2000 | Arai | B41J 2/04528 347/14 |
| 6,412,901 | B2 | 7/2002 | Su et al. | |
| 6,648,434 | B2 | 11/2003 | Walker et al. | |
| 7,600,845 | B2 | 10/2009 | Ishizaki | |
| 7,955,797 | B2 | 6/2011 | McManus et al. | |
| 2005/0057596 | A1 | 3/2005 | Shinkawa et al. | |

(Continued)

FOREIGN PATENT DOCUMENTS

| | | |
|---|---|---|
| CN | 1524694 | 9/2004 |
| CN | 101638011 | 2/2010 |

(Continued)

OTHER PUBLICATIONS

Cedo Zlebic, et al. Inkjet Printed Resistive Strain Gages on Flexible Substrates, Mar. 2016 pp. 89-100.

*Primary Examiner* — Sharon Polk
(74) *Attorney, Agent, or Firm* — Dicke Billig & Czaja PLLC

(57) ABSTRACT

A fluid ejection system includes a fluid ejection die, a service station assembly, and a controller. The fluid ejection die includes at least one strain gauge sensor to sense strain. The service station assembly is to service the fluid ejection die. The controller is to receive the sensed strain from the at least one strain gauge sensor during servicing of the fluid ejection die and adjust or stop servicing of the fluid ejection die in response to the sensed strain exceeding a servicing threshold.

20 Claims, 11 Drawing Sheets

(56) References Cited

U.S. PATENT DOCUMENTS

| | | | | |
|---|---|---|---|---|
| 2006/0066664 | A1* | 3/2006 | Kachi | B41J 2/16579 347/33 |
| 2006/0066665 | A1* | 3/2006 | Kachi | B41J 2/16538 347/33 |
| 2006/0098056 | A1 | 5/2006 | Chou | |
| 2009/0279912 | A1 | 11/2009 | Jones et al. | |
| 2014/0098153 | A1 | 4/2014 | Moore et al. | |
| 2016/0243825 | A1 | 8/2016 | Kamiyanagi et al. | |
| 2017/0003078 | A1 | 1/2017 | Vadder | |
| 2019/0375206 | A1* | 12/2019 | Anderson | B41J 2/125 |
| 2020/0171836 | A1* | 6/2020 | Gardner | H04N 1/00 |

FOREIGN PATENT DOCUMENTS

| | | |
|---|---|---|
| CN | 102905903 | 1/2013 |
| CN | 105873765 | 8/2016 |
| EP | 0547921 | 8/1997 |
| EP | 1057638 | 12/2000 |
| EP | 1457766 | 9/2004 |
| JP | 2004314457 | 11/2004 |
| JP | 2007326237 | 12/2007 |
| JP | 2016078357 | 5/2016 |
| JP | 2016112713 | 6/2016 |
| JP | 2016150574 | 8/2016 |

* cited by examiner

FLUID EJECTION DIES INCLUDING STRAIN GAUGE SENSORS

BACKGROUND

An inkjet printing system, as one example of a fluid ejection system, may include a printhead, an ink supply which supplies liquid ink to the printhead, and an electronic controller which controls the printhead. The printhead, as one example of a fluid ejection device, ejects drops of ink through a plurality of nozzles or orifices and toward a print medium, such as a sheet of paper, so as to print onto the print medium. In some examples, the orifices are arranged in at least one column or array such that properly sequenced ejection of ink from the orifices causes characters or other images to be printed upon the print medium as the printhead and the print medium are moved relative to each other.

DETAILED DESCRIPTION

Figure 1A:
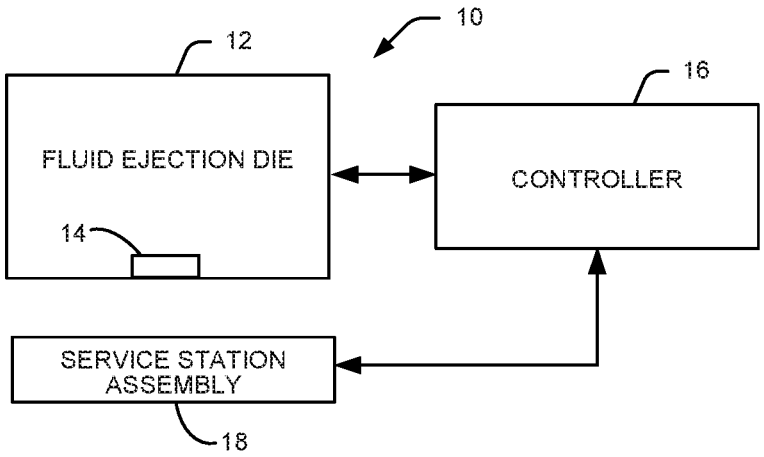
FIG. 1A is a block diagram illustrating one example of a fluid ejection system.

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims. It is to be understood that features of the various examples described herein may be combined, in part or whole, with each other, unless specifically noted otherwise.

Printheads may be serviced by a service station assembly within an inkjet printing system to maintain nozzle health and extend the life of the printheads. Some inks used in inkjet printing systems may be difficult to jet and may suffer from puddling, crusting, and/or decap. Accordingly, one type of printhead servicing includes periodically wiping the printheads to remove the excess ink from the printheads. Optimal nozzle servicing is critical to provide the highest print quality and minimal customer interruptions. Therefore, it would be advantageous to be able to determine the force applied to the printhead due to servicing. Pressures that are too high may damage the printhead while pressures that are too low may ineffectively service the printhead.

In addition, it would be advantageous to be able to detect and react to a printhead impact to the print medium or other object before further damage occurs. Being able to detect the severity of impacts to determine whether a printhead change is necessary would also be useful. Some printhead to print medium impacts result in contact to the printhead surface that smear print results but do not completely halt the medium. In these cases, if a portion of the medium (e.g., corrugate packaging) is torn and drags across the printhead, the printhead may be damaged if the printhead is not stopped immediately. The print job may also need to be discarded if the printhead is not stopped immediately. Printhead impacts and the defective print jobs resulting therefrom often go undetected until print quality audits are completed, resulting in large waste to the customer. Latent detection of printhead impacts may also result in permanent damage to the printhead.

Currently, no measurement capability exists in production printheads that provides insight as to the strain experienced by the printhead throughout the life of the printhead. The primary indicator that strain levels have exceeded safe limits is a cracked die. This results in downtime for customers, lost print jobs, and a reactive response to something that may have been easily detectable and avoided. Accordingly, it would be advantageous to be able to detect and react to impending printhead failure before the failure actually happens. Further, it would be advantageous to be able to detect when a fluid ejection system is exhibiting significant vibration, which may either indicate damaged components or an otherwise hostile operating environment.

Accordingly, disclosed herein is a fluid ejection system including one or a plurality of strain gauge sensors integrated within a fluid ejection die of a printhead assembly of the fluid ejection system. The strain gauge sensors sense strain during servicing of the fluid ejection die to calibrate a servicing station or stop servicing based on the sensed strain. The strain gauge sensors sense strain during operation of the fluid ejection system to detect impacts or vibration of the fluid ejection die based on the sensed strain. The strain gauge sensors sense strain over time to detect whether the fluid ejection die is close to failure based on the sensed strain. Operation of the fluid ejection system may be stopped or a user of the fluid ejection system may be alerted based on the sensed strain.

FIG. 1A is a block diagram illustrating one example of a fluid ejection system 10. Fluid ejection system 10 includes a fluid ejection die 12, a controller 16, and a service station assembly 18. Fluid ejection die 12 includes at least one strain gauge sensor 14 to sense strain. Service station assembly 18 services fluid ejection die 12. Controller 16 receives the sensed strain from the at least one strain gauge sensor 14 during servicing of the fluid ejection die 12 and adjusts or stops servicing of fluid ejection die 12 in response to the sensed strain exceeding a servicing threshold. The servicing threshold may be set to prevent servicing station assembly 18 from applying a pressure to fluid ejection die 12 that could damage the die.

In one example, fluid ejection die 12 includes a plurality of strain gauge sensors, where each of the plurality of strain gauge sensors sense a strain of fluid ejection die 12. In this example, controller 16 receives the sensed strain from each of the plurality of strain gauge sensors during servicing of fluid ejection die 12. In another example, controller 16 receives a baseline sensed strain from the at least one strain gauge sensor 14 in response to installing fluid ejection die 12 in fluid ejection system 10 and alerts a user of the fluid ejection system in response to the baseline sensed strain exceeding a baseline threshold. The baseline threshold may be set such that a strain exceeding the baseline threshold indicates a defective or damaged fluid ejection die.

In another example, controller 16 receives the sensed strain from the at least one strain gauge sensor 14 over time, compares the sensed strain to a failure threshold indicating proximate failure of fluid ejection die 14, and alerts a user of fluid ejection system 10 in response to the sensed strain exceeding the failure threshold. In this way, the user of fluid ejection system 10 may be notified of a fluid ejection die that is close to failure so that the fluid ejection die can be replaced prior to failure.

In another example, controller 16 receives the sensed strain from the at least one strain gauge sensor 14 during operation (e.g., printing) of the fluid ejection die, determines whether the fluid ejection die 12 has impacted an object (e.g., print media) based on the sensed strain, and stops operation of the fluid ejection die in response to an impact. In another example, controller 16 receives the sensed strain from the at least one strain gauge sensor 14 during operation of the fluid ejection die, determines whether the fluid ejection die is vibrating based on the sensed strain, and adjusts or stops operation of the fluid ejection die in response to vibration exceeding a vibration threshold. The vibration threshold may be set to prevent damage to the fluid ejection die and/or other fluid ejection system components, and/or to prevent a defective print job.

Figure 1B:
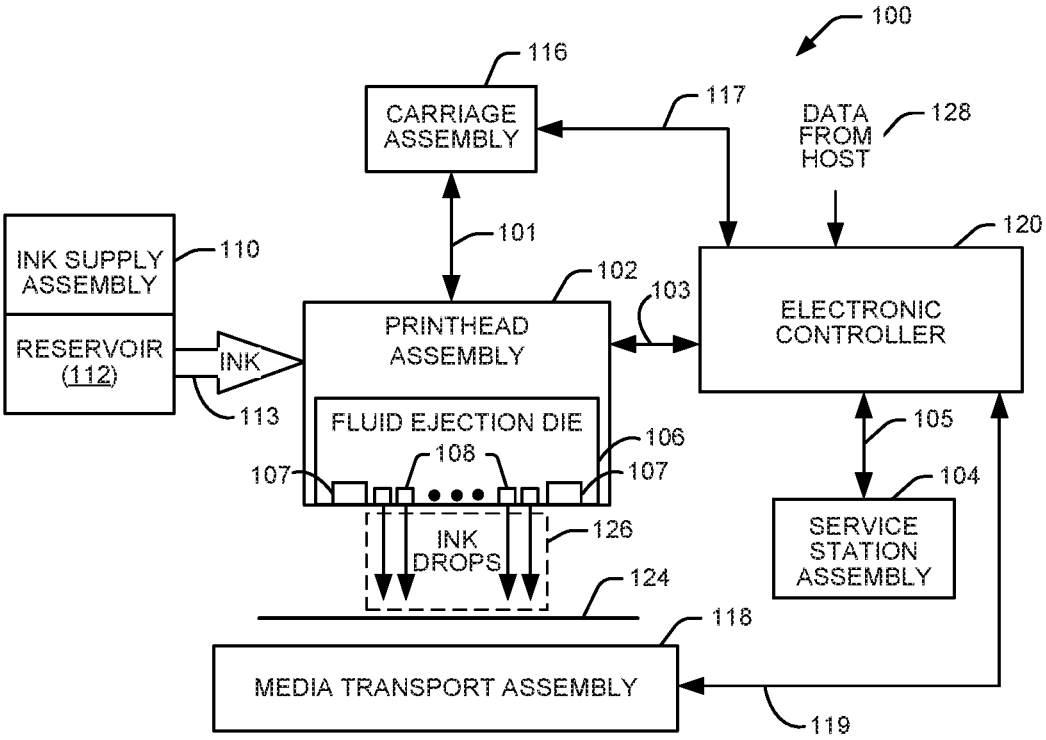
FIG. 1B is a block diagram illustrating another example of a fluid ejection system.

FIG. 1B is a block diagram illustrating another example a fluid ejection system 100. Fluid ejection system 100 includes a fluid ejection assembly, such as printhead assembly 102, and a fluid supply assembly, such as ink supply assembly 110. In the illustrated example, fluid ejection system 100 also includes a service station assembly 104, a carriage assembly 116, a print media transport assembly 118, and an electronic controller 120. In other examples, fluid ejection system 100 may include a plurality of service station assemblies 104. While the following description provides examples of systems and assemblies for fluid handling with regard to ink, the disclosed systems and assemblies are also applicable to the handling of fluids other than ink.

Printhead assembly 102 includes at least one printhead or fluid ejection die 106 which ejects drops of ink or fluid through a plurality of orifices or nozzles 108. In one example, the drops are directed toward a medium, such as print media 124, so as to print onto print media 124. In one example, print media 124 includes any type of suitable sheet material, such as paper, card stock, transparencies, Mylar, fabric, and the like. In another example, print media 124 includes media for three-dimensional (3D) printing, such as a powder bed, or media for bioprinting and/or drug discovery testing, such as a reservoir or container. In one example, nozzles 108 are arranged in at least one column or array such that properly sequenced ejection of ink from nozzles 108 causes characters, symbols, and/or other graphics or images to be printed upon print media 124 as printhead assembly 102 and print media 124 are moved relative to each other.

Fluid ejection die 106 also includes a plurality of strain gauge sensors 107. The strain gauge sensors 107 sense strain within fluid ejection die 106. In one example, strain gauge sensors 107 sense strain within fluid ejection die 106 during servicing of fluid ejection die 106 by service station assembly 104. In another example, strain gauge sensors 107 sense strain within fluid ejection die 106 during operation (e.g., printing) of fluid ejection system 100. In another example, strain gauge sensors 107 sense strain within fluid ejection die 106 over time during the life of fluid ejection die 106.

Ink supply assembly 110 supplies ink to printhead assembly 102 and includes a reservoir 112 for storing ink. As such, in one example, ink flows from reservoir 112 to printhead assembly 102. In one example, printhead assembly 102 and ink supply assembly 110 are housed together in an inkjet or fluid-jet print cartridge or pen. In another example, ink supply assembly 110 is separate from printhead assembly 102 and supplies ink to printhead assembly 102 through an interface connection 113, such as a supply tube and/or valve.

Carriage assembly 116 positions printhead assembly 102 relative to print media transport assembly 118 and print media transport assembly 118 positions print media 124 relative to printhead assembly 102. Thus, a print zone 126 is defined adjacent to nozzles 108 in an area between printhead assembly 102 and print media 124. In one example, printhead assembly 102 is a scanning type printhead assembly such that carriage assembly 116 moves printhead assembly 102 relative to print media transport assembly 118. In another example, printhead assembly 102 is a non-scanning type printhead assembly such that carriage assembly 116 fixes printhead assembly 102 at a prescribed position relative to print media transport assembly 118.

Service station assembly 104 provides for spitting, wiping, capping, and/or priming of printhead assembly 102 to maintain the functionality of printhead assembly 102 and, more specifically, nozzles 108. For example, service station assembly 104 may include a rubber blade, wiper, or roller which is periodically passed over printhead assembly 102 to wipe and clean nozzles 108 of excess ink. In addition, service station assembly 104 may include a cap that covers printhead assembly 102 to protect nozzles 108 from drying out during periods of non-use. In addition, service station assembly 104 may include a spittoon into which printhead assembly 102 ejects ink during spits to insure that reservoir 112 maintains an appropriate level of pressure and fluidity, and to insure that nozzles 108 do not clog or weep. Functions of service station assembly 104 may include relative motion between service station assembly 104 and printhead assembly 102.

Electronic controller 120 communicates with printhead assembly 102 through a communication path 103, service station assembly 104 through a communication path 105, carriage assembly 116 through a communication path 117, and print media transport assembly 118 through a communication path 119. In one example, when printhead assembly 102 is mounted in carriage assembly 116, electronic controller 120 and printhead assembly 102 may communicate via carriage assembly 116 through a communication path 101. Electronic controller 120 may also communicate with ink supply assembly 110 such that, in one implementation, a new (or used) ink supply may be detected.

Electronic controller 120 receives data 128 from a host system, such as a computer, and may include memory for temporarily storing data 128. Data 128 may be sent to fluid ejection system 100 along an electronic, infrared, optical or other information transfer path. Data 128 represent, for example, a document and/or file to be printed. As such, data 128 form a print job for fluid ejection system 100 and includes at least one print job command and/or command parameter.

In one example, electronic controller 120 provides control of printhead assembly 102 including timing control for ejection of ink drops from nozzles 108. As such, electronic controller 120 defines a pattern of ejected ink drops which form characters, symbols, and/or other graphics or images on print media 124. Timing control and, therefore, the pattern of ejected ink drops, is determined by the print job commands and/or command parameters. In one example, logic and drive circuitry forming a portion of electronic controller 120 is located on printhead assembly 102. In another example, logic and drive circuitry forming a portion of electronic controller 120 is located off printhead assembly 102.

Electronic controller 120 also receives the sensed strain from each of the plurality of strain gauge sensors 107 during servicing of fluid ejection die 106 during which a servicing component (e.g., wiper) comes into contact with fluid ejection die 106. In one example, electronic controller 120 calibrates the servicing component of service station assembly 104 in response to the sensed strain from each of the plurality of strain gauge sensors 107. In another example, electronic controller 120 provides data to a user of fluid ejection system 100 for manual calibration of service station assembly 104 by the user in response to the sensed strain from each of the plurality of strain gauge sensors 107.

By monitoring the output of the strain gauge sensors 107 during servicing, electronic controller 120 may determine whether components of service station assembly 104 are appropriately adjusted. If components of service station assembly 104 are found to not be appropriately adjusted, electronic controller 120 may take appropriate actions to address the issue. Too little pressure may result in ineffective servicing of fluid ejection die 106 while too much pressure may damage fluid ejection die 106 and/or force air into nozzles 108, which creates additional problems. In addition, the output of the strain gauge sensors 107 may be monitored to determine if the pressure is too low at one end of fluid ejection die 106 while too high at the other end of fluid ejection die 106. In this case, a tilt adjustment of components of service station assembly 104 may be made to appropriately adjust the pressures on both ends of fluid ejection die 106. Based on the output of strain gauge sensors 107, electronic controller 120 may alert a user of fluid ejection system 100 that there is a problem, adjust components of service station assembly 104, and/or stop servicing of fluid ejection die 106.

In one example, electronic controller 120 may also receive the sensed strain from each of the plurality of strain gauge sensors 107 during operation of the fluid ejection die 106. By monitoring the output of the strain gauge sensors 107 during operation of fluid ejection die 106, electronic controller 102 can determine if fluid ejection die 106 comes into contact with the print media or some other object (i.e., a crash) and then take appropriate actions to address the issue. The actions may include alerting the user of fluid ejection system 100 that there is a problem or stopping operation of fluid ejection system 100.

In another example, electronic controller 120 may also receive the sensed strain from each of the plurality of strain gauge sensors 107 to monitor vibrations of fluid ejection die 106. The vibrations may be due to sources external to fluid ejection system 100 (e.g., fluid ejection system 100 being moved while operating or placed in a mobile environment) or may be due to sources internal to fluid ejection system 100 (e.g., worn or defective rollers and/or motors). By monitoring the output of strain gauge sensors 107, electronic controller 120 can take appropriate actions in response to detecting vibration. For larger fluid ejection systems 100, these actions may include alerting the user that there is a part approaching its end of life. For smaller (e.g., more mobile) fluid ejection systems 100, these actions may include alerting the user that the vibrations are too strong to allow the fluid ejection system to operate effectively or that the fluid ejection system is in an inappropriate orientation.

In another example, electronic controller 120 may also receive the sensed strain from each of the plurality of strain gauge sensors 107 to monitor the strain over time to which the fluid ejection die 106 is subjected. The measured strain may be related to ambient factors (i.e., the fluid ejection system's external environment) such as temperature cycling that leads to a cracked die failure. The measured strain may also be related to conditions created by the fluid ejection die 106 itself, such as rapid temperature change due to firing nozzles that stress the die and headland interfaces (i.e., the interfaces between fluid ejection die 106 and printhead assembly 102) hundreds of thousands of times over the life of the fluid ejection die. It is known that over time ink soaks into structural adhesives in the headland causing swelling that increases stress to the die joints. This results in increasing warpage of the printhead assembly headland. By monitoring the output of strain gauges 107 over time, and after establishing known safe limits of strain for the die, electronic controller 120 can determine if the fluid ejection die 106 is trending toward near-term failure, and then take appropriate actions to address the issue. These actions may include alerting the user of fluid ejection system 100 that there is a fluid ejection die approaching wear out or stopping operation of fluid ejection system 100.

Figure 2:
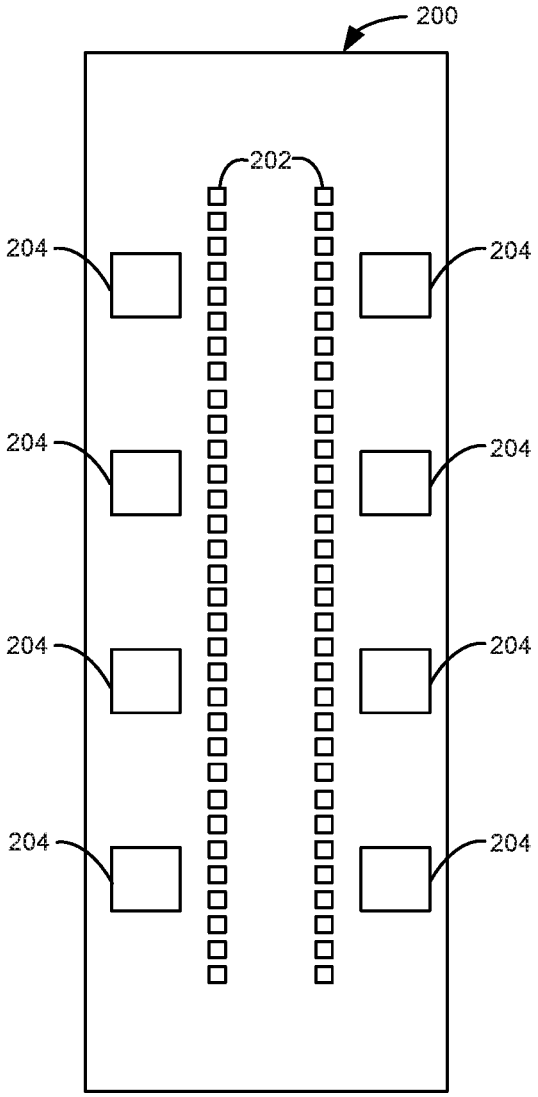
FIG. 2 illustrates a front view of one example of a fluid ejection die.

FIG. 2 illustrates a front view of one example of a fluid ejection die 200. In one example, fluid ejection die 200 provides fluid ejection die 12 previously described and illustrated with reference to FIG. 1A or fluid ejection die 106 previously described and illustrated with reference to FIG. 1B. Fluid ejection die 200 includes a plurality of nozzles 202 and a plurality of strain gauge sensors 204. In one example, fluid ejection die 200 is a silicon die and each of the plurality of strain gauge sensors 204 is integrated within the die. Each strain gauge sensor 204 senses the strain within fluid ejection die 200 at a unique location within fluid ejection die 200.

While fluid ejection die 200 includes a rectangular shape in this example, in other examples fluid ejection die 200 may have another suitable shape, such as a square shape. Fluid ejection die 200 may include any suitable number of nozzles 202 and any suitable number of strain gauge sensors 204. While fluid ejection die 200 includes nozzles 202 arranged in two columns and strain gauge sensors 204 arranged in two columns, in other examples nozzles 202 and strain gauge sensors 204 may have other suitable arrangements, such as one column of nozzles and/or one column of strain gauge sensors or more than two columns of nozzles and/or more than two columns of strain gauge sensors. Also, while fluid ejection die 200 includes strain gauge sensors 204 aligned with respect to each other, in other examples, strain gauge sensors 204 may be staggered with respect to each other. In other examples, fluid ejection die 200 may include strain gauge sensors 204 between the two columns of nozzles 202.

Figure 3A:
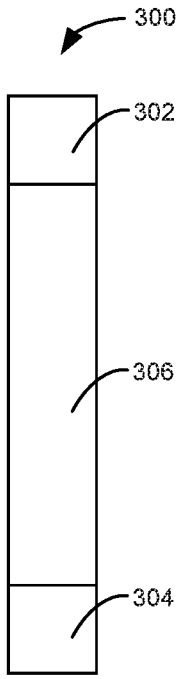
FIG. 3A illustrates one example of a strain gauge sensor.

FIG. 3A illustrates one example of a strain gauge sensor 300. In one example, strain gauge sensor 300 provides each strain gauge sensor 204 of fluid ejection die 200 previously described and illustrated with reference to FIG. 2. Strain gauge sensor 300 includes a first electrode 302, a second electrode 304, and a piezoelectric sensor element 306 electrically coupled between first electrode 302 and second electrode 304. Piezoelectric sensor element 306 exhibits a change in resistance in response to stress in one axis. Therefore, by biasing strain gauge sensor 300 (e.g., with a constant current) and measuring the voltage across piezoelectric sensor element 306, the strain on piezoelectric sensor element 306 may be sensed.

Figure 3B:
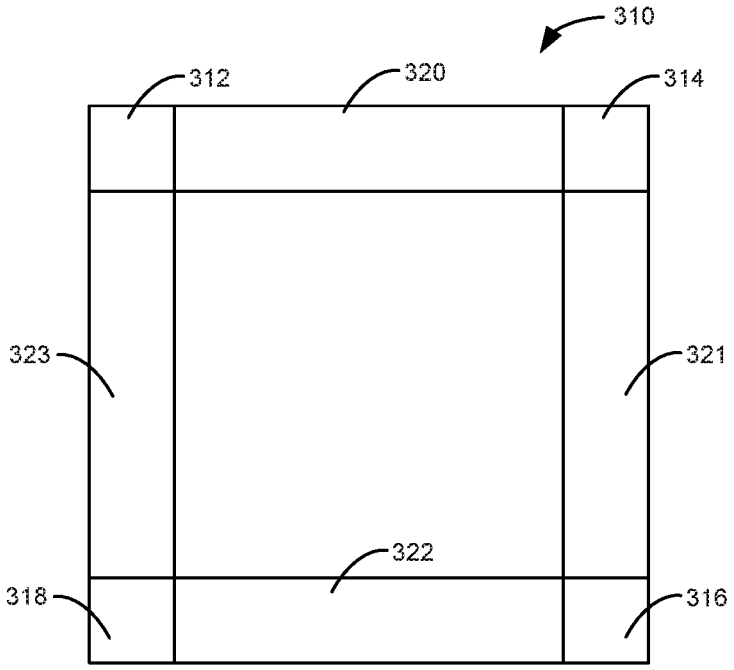
FIG. 3B illustrates another example of a strain gauge sensor.

FIG. 3B illustrates another example of a strain gauge sensor 310. In one example, strain gauge sensor 310 provides each strain gauge sensor 204 of fluid ejection die 200 previously described and illustrated with reference to FIG. 2. Strain gauge sensor 310 includes a first electrode 312, a second electrode 314, a third electrode 316, a fourth electrode 318, a first piezoelectric sensor element 320, a second piezoelectric sensor element 321, a third piezoelectric sensor element 322, and a fourth piezoelectric sensor element 323. First piezoelectric sensor element 320 is electrically coupled between first electrode 312 and second electrode 314. Second piezoelectric sensor element 321 is electrically coupled between second electrode 314 and third electrode 316. Third piezoelectric sensor element 322 is electrically coupled between third electrode 316 and fourth electrode 318. Fourth piezoelectric sensor element 323 is electrically coupled between fourth electrode 318 and first electrode 312.

Strain gauge sensor 310 exhibits a change in resistance in response to stress in two axes. Strain gauge sensor 310 may be configured in a Wheatstone bridge configuration in which an external biasing voltage is applied across two opposing electrodes (e.g., first electrode 312 and third electrode 316) while the voltage is measured across the other two opposing electrodes (e.g., second electrode 314 and fourth electrode 318). Therefore, by biasing strain gauge sensor 310 with an external voltage and measuring the voltage across piezoelectric sensor elements 320-323, the strain on strain gauge sensor 310 may be sensed.

Figure 4A:
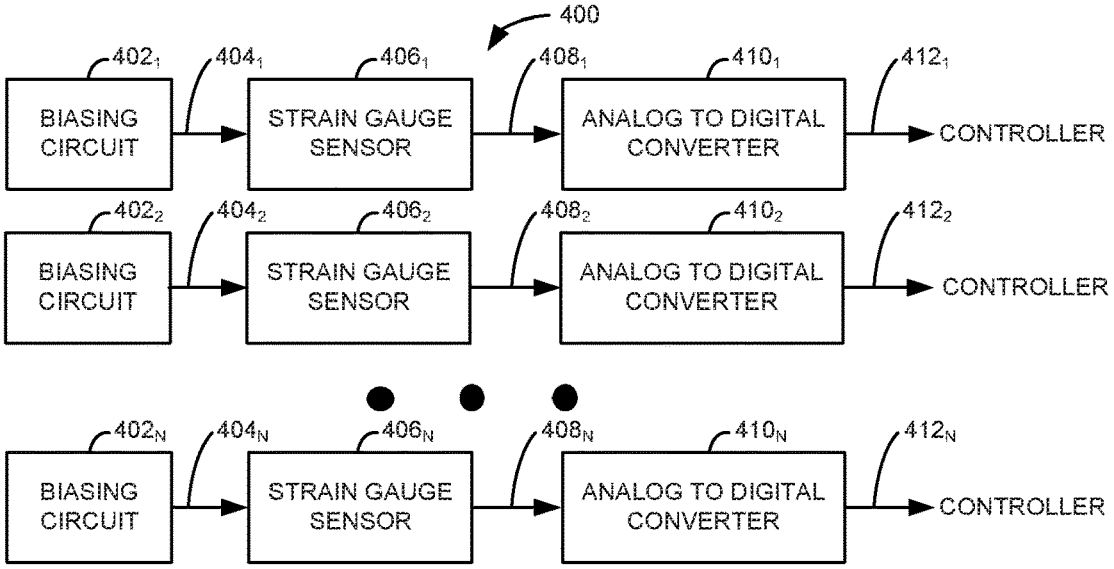
FIG. 4A is a block diagram illustrating one example of a circuit for processing signals from a plurality of strain gauge sensors.

FIG. 4A is a block diagram illustrating one example of a circuit 400 for processing signals from a plurality of strain gauge sensors. Circuit 400 includes biasing circuits $\mathbf{402}_1$ to $\mathbf{402}_N$, strain gauge sensors $\mathbf{406}_1$ to $\mathbf{406}_N$, and analog to digital converters $\mathbf{410}_1$ to $\mathbf{410}_N$, where "N" is any suitable number of strain gauge sensors on a fluid ejection die. The signals from each strain gauge sensor are passed to a controller, such as controller 16 previously described and illustrated with reference to FIG. 1A or electronic controller 120 previously described and illustrated with reference to FIG. 1B. Strain gauge sensors $\mathbf{406}_1$ to $\mathbf{406}_N$ are integrated on a fluid ejection die, such as fluid ejection die 200 previously described and illustrated with reference to FIG. 2. Biasing circuits $\mathbf{402}_1$ to $\mathbf{402}_N$ and analog to digital converters $\mathbf{410}_1$ to $\mathbf{410}_N$ may be integrated in the fluid ejection die, in a printhead assembly, in other components of the fluid ejection system, or in a combination thereof.

Each biasing circuit $\mathbf{402}_1$ to $\mathbf{402}_N$ is electrically coupled to a strain gauge sensor $\mathbf{406}_1$ to $\mathbf{406}_N$ through a signal path $\mathbf{404}_1$ to $\mathbf{404}_N$, respectively. Each strain gauge sensor $\mathbf{406}_1$ to $\mathbf{406}_N$ is electrically coupled to an analog to digital converter $\mathbf{410}_1$ to $\mathbf{410}_N$ through a signal path $\mathbf{408}_1$ to $\mathbf{408}_N$, respectively. Each analog to digital converter $\mathbf{410}_1$ to $\mathbf{410}_N$ is electrically coupled to the controller through a signal path $\mathbf{412}_1$ to $\mathbf{412}_N$, respectively.

Each biasing circuit $\mathbf{402}_1$ to $\mathbf{402}_N$ provides a biasing voltage or current to a corresponding strain gauge sensor $\mathbf{406}_1$ to $\mathbf{406}_N$. Each strain gauge sensor $\mathbf{406}_1$ to $\mathbf{406}_N$ may be provided by a strain gauge sensor 300 previously described and illustrated with reference to FIG. 3A or a strain gauge sensor 310 previously described and illustrated with reference to FIG. 3B. The voltage signal from each strain gauge sensor $\mathbf{406}_1$ to $\mathbf{406}_N$ is converted to a digital signal by a corresponding analog to digital converter $\mathbf{410}_1$ to $\mathbf{410}_N$. The digital signal corresponding to the sensed strain of each strain gauge sensor $\mathbf{406}_1$ to $\mathbf{406}_N$ is then passed to the controller. In this way, the strain of each strain gauge sensor may be sensed simultaneously.

Figure 4B:
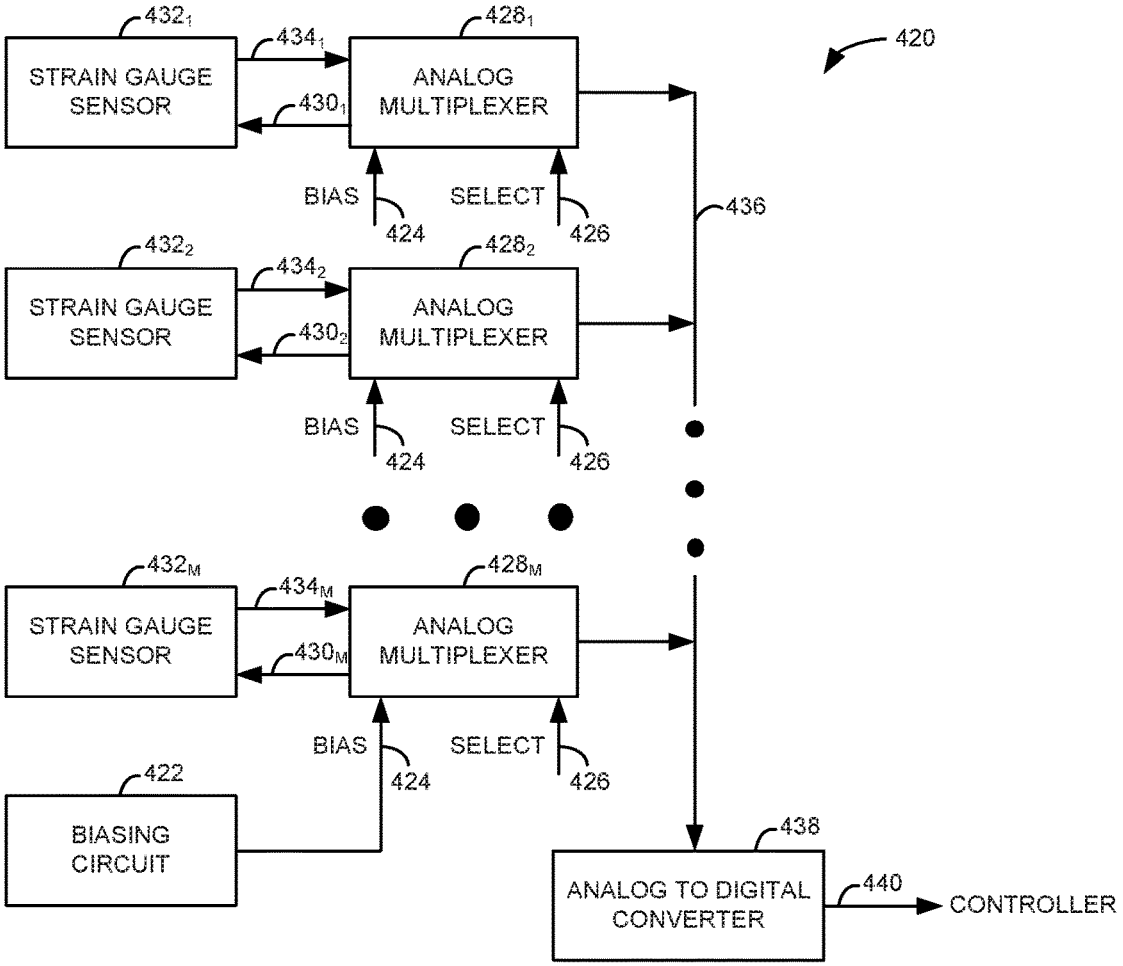
FIG. 4B is a block diagram illustrating another example of a circuit for processing signals from a plurality of strain gauge sensors.

FIG. 4B is a block diagram illustrating another example of a circuit 420 for processing signals from a plurality of strain gauge sensors. Circuit 420 includes a biasing circuit 422, analog multiplexers $\mathbf{428}_1$ to $\mathbf{428}_M$, strain gauge sensors $\mathbf{432}_1$ to $\mathbf{432}_M$, and an analog to digital converter 438, where "M" is any suitable number of strain gauge sensors on a fluid ejection die. The signals from each strain gauge sensor are passed to a controller, such as controller 16 previously described and illustrated with reference to FIG. 1A or electronic controller 120 previously described and illustrated with reference to FIG. 1B. Strain gauge sensors $\mathbf{432}_1$ to $\mathbf{432}_M$ are integrated on a fluid ejection die, such as fluid ejection die 200 previously described and illustrated with reference to FIG. 2. Biasing circuit 422, multiplexers $\mathbf{428}_1$ to $\mathbf{428}_M$, and analog to digital converter 438 may be integrated in the fluid ejection die, in a printhead assembly, in other components of the fluid ejection system, or in a combination thereof.

Biasing circuit 422 is electrically coupled to each analog multiplexer $\mathbf{428}_1$ to $\mathbf{428}_M$ through a signal path 424. Each analog multiplexer $\mathbf{428}_1$ to $\mathbf{428}_M$ also receives a select signal through a signal path 426. Each analog multiplexer $\mathbf{428}_1$ to $\mathbf{428}_M$ is electrically coupled to a strain gauge sensor $\mathbf{432}_1$ to $\mathbf{432}_M$ through a signal path $\mathbf{430}_1$ to $\mathbf{430}_M$, respectively. Each strain gauge sensor $\mathbf{432}_1$ to $\mathbf{432}_M$ is electrically coupled to an analog multiplexer $\mathbf{428}_1$ to $\mathbf{428}_M$ through a signal path $\mathbf{434}_1$ to $\mathbf{434}_M$, respectively. Each analog multiplexer $\mathbf{428}_1$ to $\mathbf{428}_M$ is electrically coupled to analog to digital converter 438 through a signal path 436. Analog to digital converter 438 is electrically coupled to the controller through a signal path 440.

Biasing circuit 422 provides a biasing voltage or current to each analog multiplexer $\mathbf{428}_1$ to $\mathbf{428}_M$. In response to the select signal on signal path 426 corresponding to an analog multiplexer $\mathbf{428}_1$ to $\mathbf{428}_M$, the selected analog multiplexer $\mathbf{428}_1$ to $\mathbf{428}_M$ passes the biasing voltage or current to the corresponding strain gauge sensor $\mathbf{432}_1$ to $\mathbf{432}_M$ through the corresponding signal path $\mathbf{430}_1$ to $\mathbf{430}_M$. Each strain gauge sensor $\mathbf{432}_1$ to $\mathbf{432}_M$ may be provided by a strain gauge sensor 300 previously described and illustrated with reference to FIG. 3A or a strain gauge sensor 310 previously described and illustrated with reference to FIG. 3B. The voltage signal from the selected strain gauge sensor $\mathbf{432}_1$ to $\mathbf{432}_M$ is passed to the selected analog multiplexer $\mathbf{428}_1$ to $\mathbf{428}_M$ through the corresponding signal path $\mathbf{434}_1$ to $\mathbf{434}_M$. The selected analog multiplexer $\mathbf{428}_1$ to $\mathbf{428}_M$ then passes the voltage signal to analog to digital converter 438. Analog to digital converter 438 converts the voltage signal to a digital signal. The digital signal corresponding to the sensed strain of the selected strain gauge sensor $\mathbf{432}_1$ to $\mathbf{432}_M$ is then passed to the controller. In this way, a single biasing circuit and a single analog to digital converter may be used to sense the strain of multiple strain gauge sensors by sensing the strain of one strain gauge sensor at a time.

Figure 5:
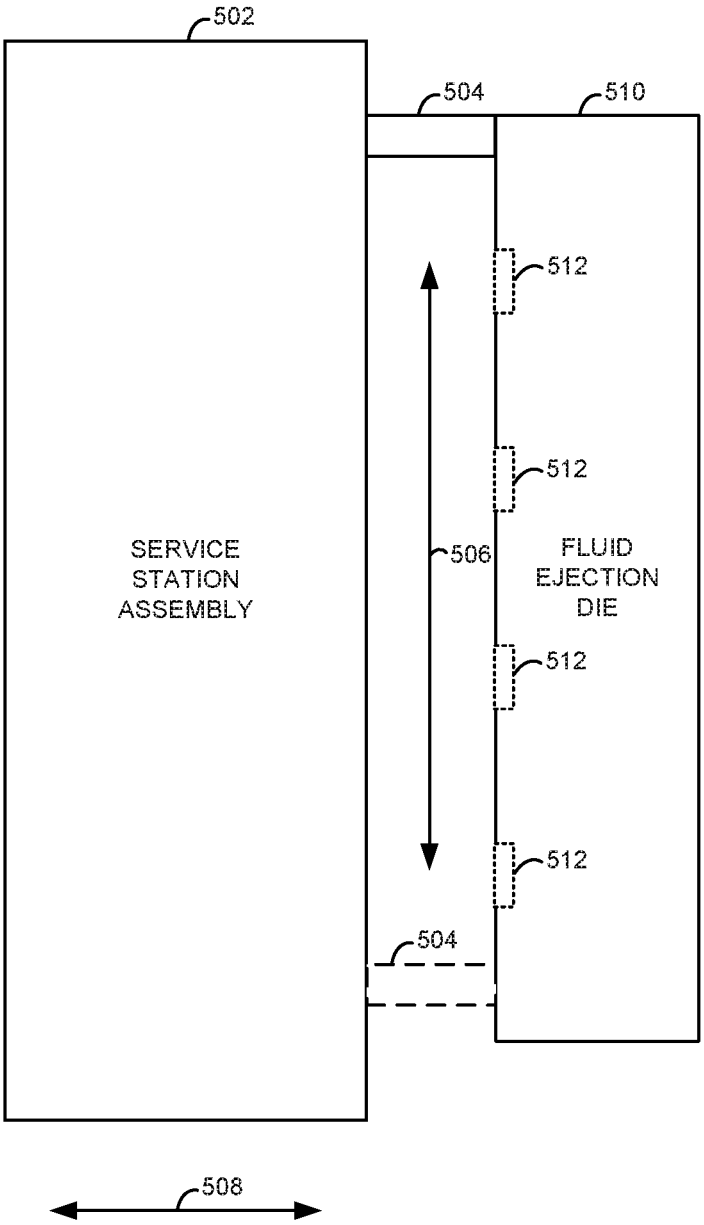
FIG. 5 illustrates a side view of one example of a service station assembly servicing a fluid ejection die.

FIG. 5 illustrates a side view of one example of a service station assembly 502 servicing a fluid ejection die 510. In one example, service station assembly 502 provides service station assembly 18 and fluid ejection die 510 provides fluid ejection die 12 previously described and illustrated with reference to FIG. 1A. In another example, service station assembly 502 provides service station assembly 104 and fluid ejection die 510 provides fluid ejection die 106 previously described and illustrated with reference to FIG. 1B. Fluid ejection die 510 includes strain gauge sensors 512 indicated by dotted lines, such as strain gauge sensors 300 previously described and illustrated with reference to FIG. 3A or strain gauge sensors 310 previously described and illustrated with reference to FIG. 3B.

Service station assembly 502 includes a servicing component 504 (e.g., wiper). Servicing component 504 may be moved relative to fluid ejection die 510 as indicated at 506. Servicing component 504 may be moved into contact with fluid ejection die 510 for servicing of fluid ejection die 510 and moved out of contact with fluid ejection die 510 when fluid ejection die 510 is not being serviced as indicated at 508. During servicing, servicing component 504 may be moved across fluid ejection die 510 to remove excess ink from fluid ejection die 510. The servicing component 504 indicated by solid lines indicates a first position of servicing component 504 while the servicing component 504 indicated by dashed lines indicates a second position of servicing component 504.

Strain gauge sensors 512 measure the strain exerted upon fluid ejection die 510 by servicing component 504 when fluid ejection die 510 is being serviced by service station assembly 502. The sensed strain from each strain gauge sensor 512 may be used to calibrate service station assembly 502 including servicing component 504 so that service station assembly 502 applies optimal pressure on fluid ejection die 510 during servicing. The sensed strain from each strain gauge sensor 512 may also be compared to a servicing threshold and servicing of fluid ejection die 510 may be stopped in response a sensed strain exceeding the servicing threshold.

Figure 6A:
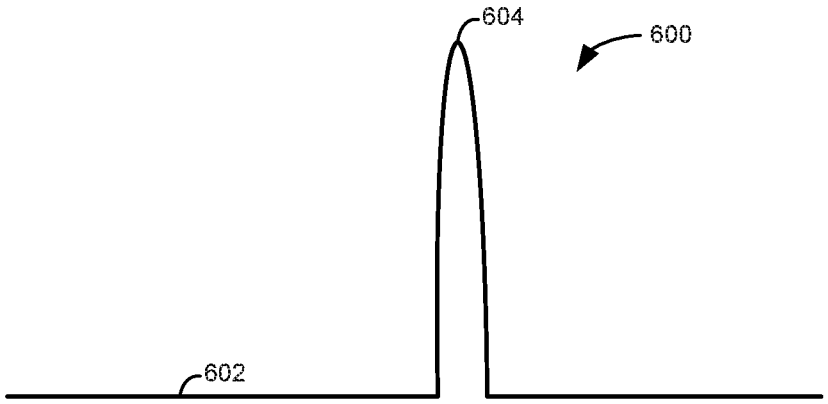
FIG. 6A illustrates one example of a strain gauge sensor signal corresponding to a fluid ejection die impact event.

FIG. 6A illustrates one example of a strain gauge sensor signal 600 corresponding to a fluid ejection die impact event. Prior to an impact event, the strain gauge sensor outputs a baseline strain indicated at 602. The baseline strain indicated at 602 may be sensed during a fluid ejection system idle time when the fluid ejection system is neither operating nor being serviced. Upon an impact event in which the fluid ejection die comes into brief contact with an object (e.g., print media), the strain gauge sensor outputs a signal that rises rapidly to a peak value as indicated at 604 and then falls rapidly back to the baseline strain 602. The peak value at 604 may be used to determine the severity of the impact. The peak value at 604 may be compared to an impact threshold to determine whether damage to the fluid ejection die likely occurred or not, whether operation of the fluid ejection system should be stopped, or whether the user of the fluid ejection system should be alerted.

Figure 6B:
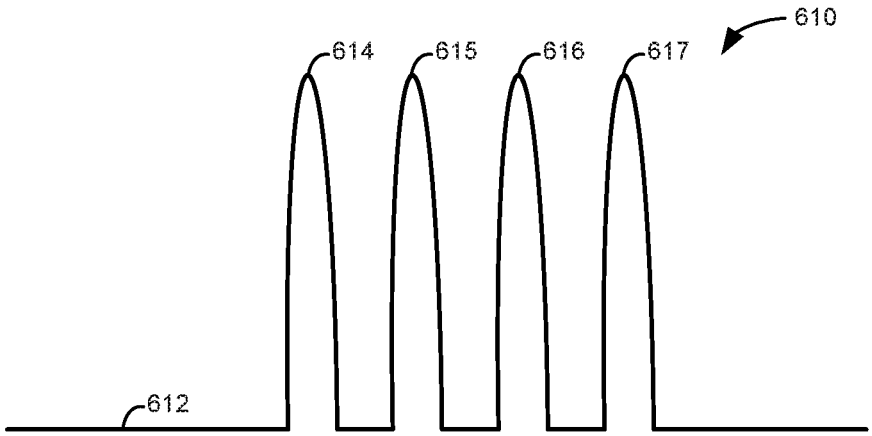
FIG. 6B illustrates another example of a strain gauge sensor signal corresponding to a fluid ejection die impact event.

FIG. 6B illustrates another example of a strain gauge sensor signal 610 corresponding to a fluid ejection die impact event. Prior to an impact event, the strain gauge sensor outputs a baseline strain indicated at 612. The baseline strain indicated at 612 may be sensed during a fluid ejection system idle time when the fluid ejection system is neither operating nor being serviced. Upon an impact event in which the fluid ejection die comes into contact with an object (e.g., print media), the strain gauge sensor outputs a signal that rapidly rises and falls back to the baseline strain 612 multiples times as indicated by peak values 614-617. While the peak values 614-617 are indicated as being equal, the peak values may vary depending upon the impact. The number of peaks may also vary depending upon the impact. The peak signal values at 614-617 may be used to determine the severity of the impact. The peak values 614-617 may be compared to an impact threshold to determine whether damage to the fluid ejection die likely occurred or not, whether operation of the fluid ejection system should be stopped, or whether the user of the fluid ejection system should be alerted.

Figure 6C:
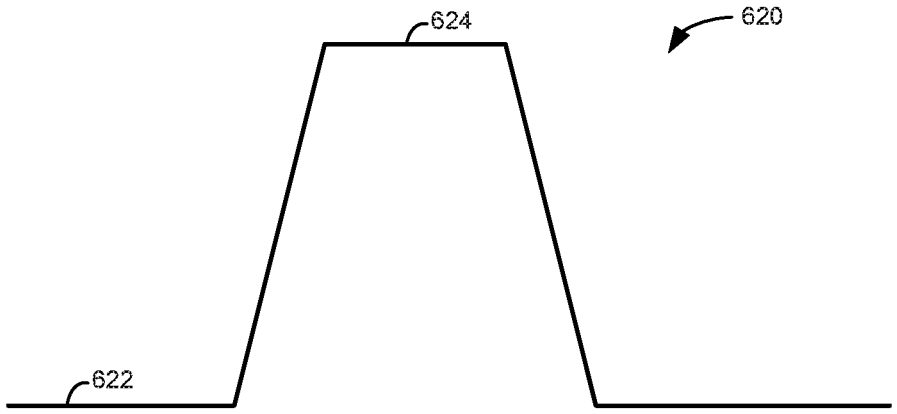
FIG. 6C illustrates one example of a strain gauge sensor signal corresponding to a fluid ejection die servicing event.

FIG. 6C illustrates one example of a strain gauge sensor signal 620 corresponding to a fluid ejection die servicing event. Prior to a servicing event, the strain gauge sensor outputs a baseline strain indicated at 622. The baseline strain indicated at 622 may be sensed during a fluid ejection system idle time when the fluid ejection system is neither operating nor being serviced. Upon the start of a servicing event in which the fluid ejection die comes into contact with a component of a service station assembly, the strain gauge sensor outputs a signal that rises rapidly to a peak value as indicated at 624. The peak value at 624 is maintained while the component of the service station assembly remains in contact with the fluid ejection die. Once servicing of the fluid ejection die is complete and the component of the service station assembly is moved away from the fluid ejection die, the strain gauge sensor outputs a signal that falls rapidly back to the baseline strain 622. The peak value at 624 may be used to calibrate the service station assembly including the servicing component so that an optimal pressure is applied to the fluid ejection die during servicing. The strain gauge signal may also be compared to a servicing threshold to determine whether servicing of the fluid ejection die should be stopped or whether the user of the fluid ejection system should be alerted.

Figure 6D:
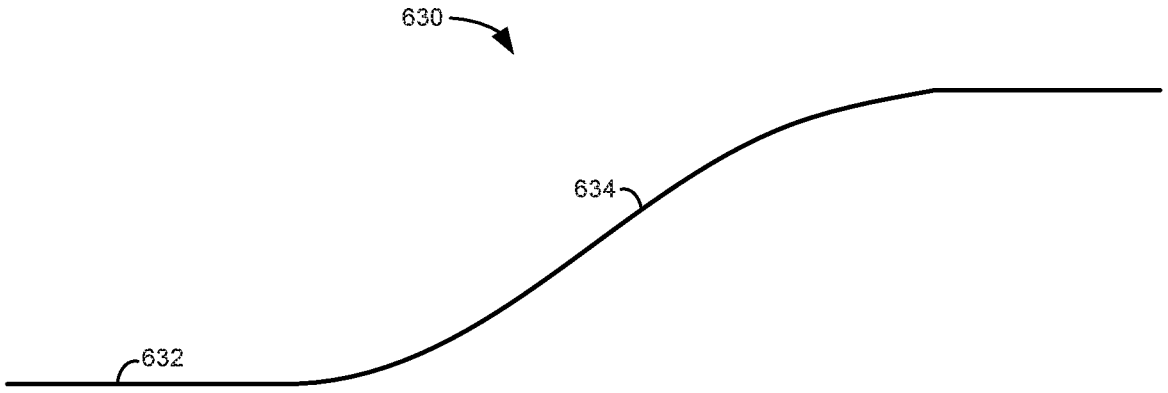
FIG. 6D illustrates one example of a strain gauge sensor signal corresponding to an increase in strain within a fluid ejection die over time.

FIG. 6D illustrates one example of a strain gauge sensor signal 630 corresponding to an increase in strain within a fluid ejection die over time. Initially, the fluid ejection die exhibits a baseline strain as indicated at 632. The baseline strain indicated at 632 may be sensed when the fluid ejection die is first installed in the fluid ejection system during a fluid ejection system idle time when the fluid ejection system is neither operating nor being serviced. Over time, the strain may gradually rise as indicated at 634. The sensed strain over time may be used to determine whether the fluid ejection die is close to failure. The strain gauge signal may also be compared to a failure threshold to determine whether the use of the fluid ejection die should be stopped or whether the user of the fluid ejection system should be alerted.

Figure 6E:
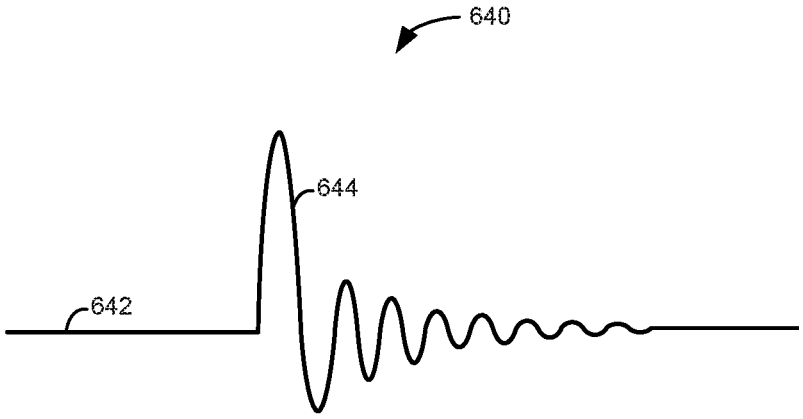
FIG. 6E illustrates one example of a strain gauge sensor signal corresponding to vibration of a fluid ejection die.

FIG. 6E illustrates one example of a strain gauge sensor signal 640 corresponding to vibration of a fluid ejection die. Prior to detecting vibrations, the strain gauge sensor outputs a baseline strain indicated at 642. The baseline strain indicated at 642 may be sensed during a fluid ejection system idle time when the fluid ejection system is neither operating nor being serviced. When the fluid ejection die is subjected to vibrations, the strain gauge sensor outputs a signal that rapidly oscillates above and below the baseline strain 642 multiples times as indicated at 644 until the vibrations dissipate. The peak signal values and the length of time the vibrations persist may be used to determine the severity of the vibrations. The peak values and/or the length of time the vibrations persist may be compared to vibration thresholds to determine whether operation of the fluid ejection system should be stopped or whether the user of the fluid ejection system should be alerted.

Figure 6F:
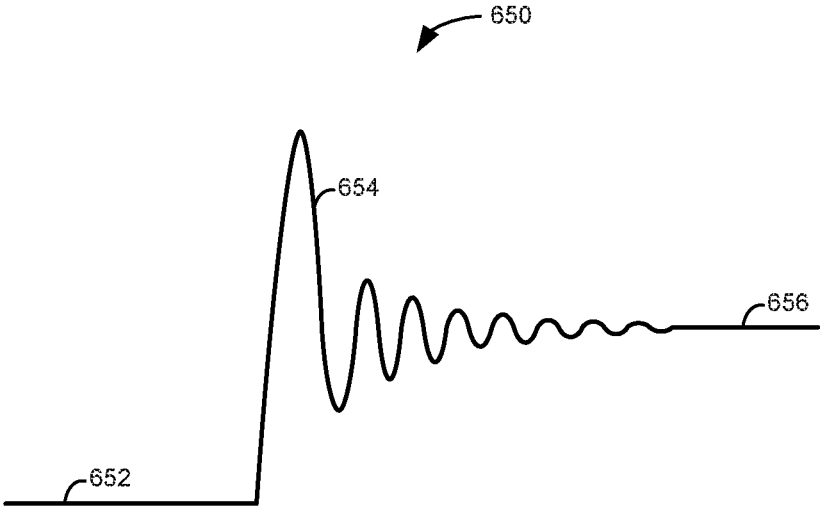
FIG. 6F illustrates one example of a strain gauge sensor signal that does not return to a baseline strain after an event.

FIG. 6F illustrates one example of a strain gauge sensor signal 650 that does not return to a baseline strain after an event. Prior to detecting an event, such as an impact or vibrations, the strain gauge sensor outputs a baseline strain indicated at 652. The baseline strain indicated at 652 may be sensed during a fluid ejection system idle time when the fluid ejection system is neither operating nor being serviced. When the fluid ejection die is subjected to an event, the strain gauge sensor may output a signal that rapidly oscillates above the baseline strain 652 multiples times as indicated at 654 until the signal settles at a strain 656 above the baseline strain 652. The peak signal values and the strain at 656 may be used to determine the severity of the event. The peak values and/or the strain at 656 may be compared to thresholds to determine whether the fluid ejection die has been damaged, whether operation of the fluid ejection system should be stopped, or whether the user of the fluid ejection system should be alerted.

Figure 7:
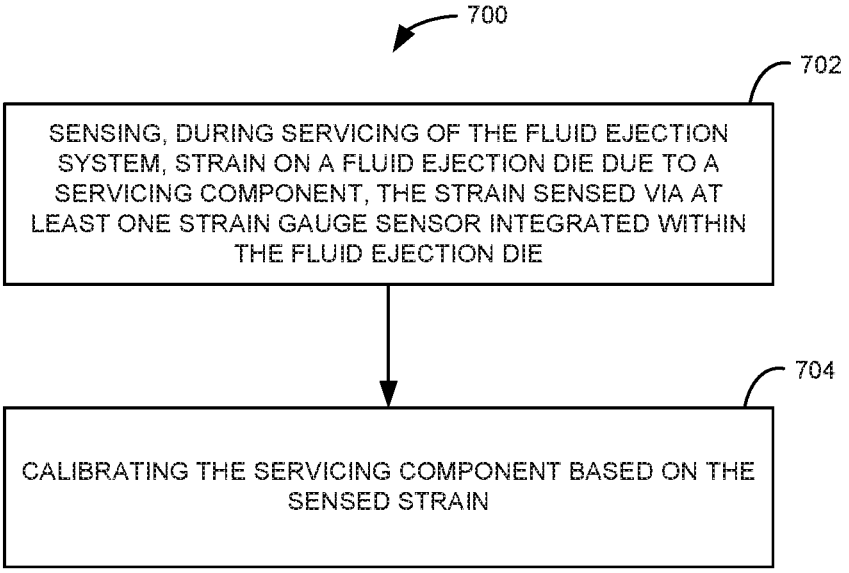
FIG. 7 is a flow diagram illustrating one example of a method for maintaining a fluid ejection system.

FIG. 7 is a flow diagram illustrating one example of a method 700 for maintaining a fluid ejection system. At 702, method 700 includes sensing, during servicing of the fluid ejection system, strain on a fluid ejection die due to a servicing component, the strain sensed via at least one strain gauge sensor integrated within the fluid ejection die. In one example, sensing strain on the fluid ejection die includes sensing strain on the fluid ejection die via a plurality of strain gauge sensors integrated within the fluid ejection die. At 704, method 700 includes calibrating the servicing component based on the sensed strain. In one example, method 700 also includes stopping servicing of the fluid ejection system in response to the sensed strain exceeding a threshold.

Figure 8:
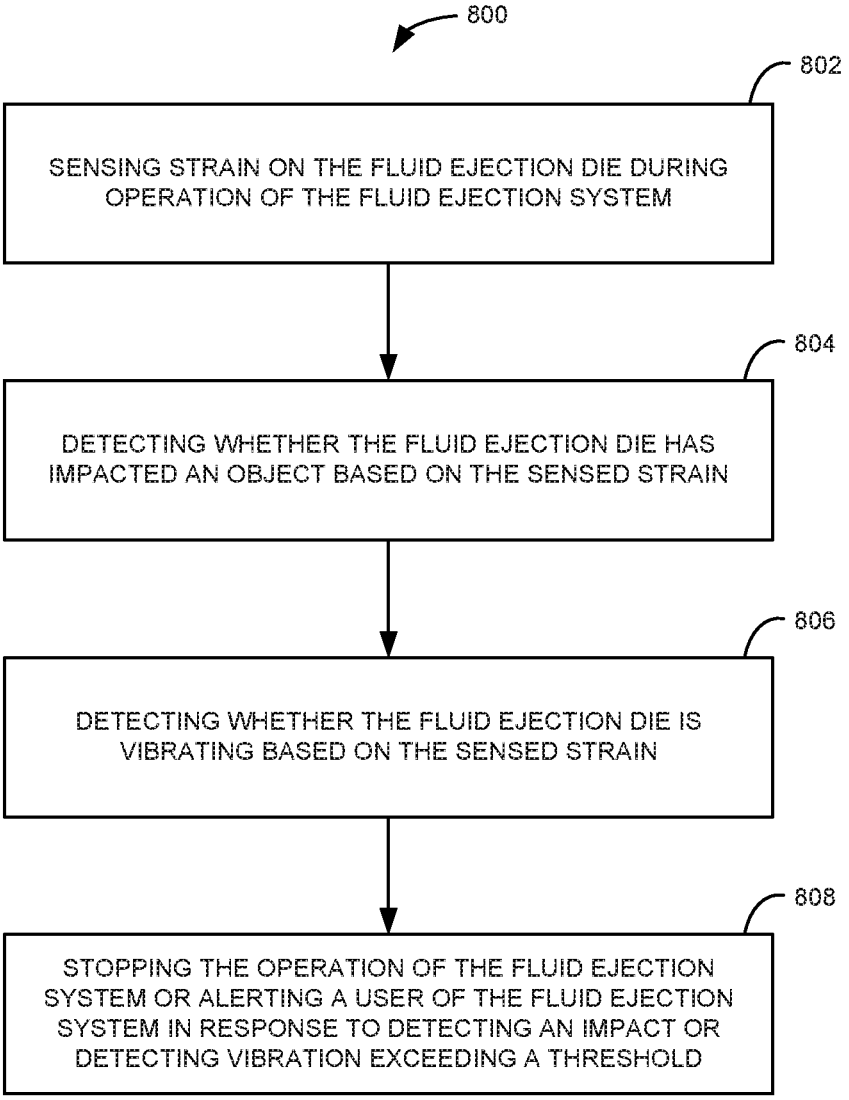
FIG. 8 is a flow diagram illustrating another example of a method for maintaining a fluid ejection system.

FIG. 8 is a flow diagram illustrating another example of a method 800 for maintaining a fluid ejection system. At 802, method 800 includes sensing strain on the fluid ejection die during operation of the fluid ejection system. At 804, method 800 includes detecting whether the fluid ejection die has impacted an object based on the sensed strain. At 806, method 800 includes detecting whether the fluid ejection die is vibrating based on the sensed strain. At 808, method 800 includes stopping the operation of the fluid ejection system or alerting a user of the fluid ejection system in response to detecting an impact or detecting vibration exceeding a threshold.

Figure 9:
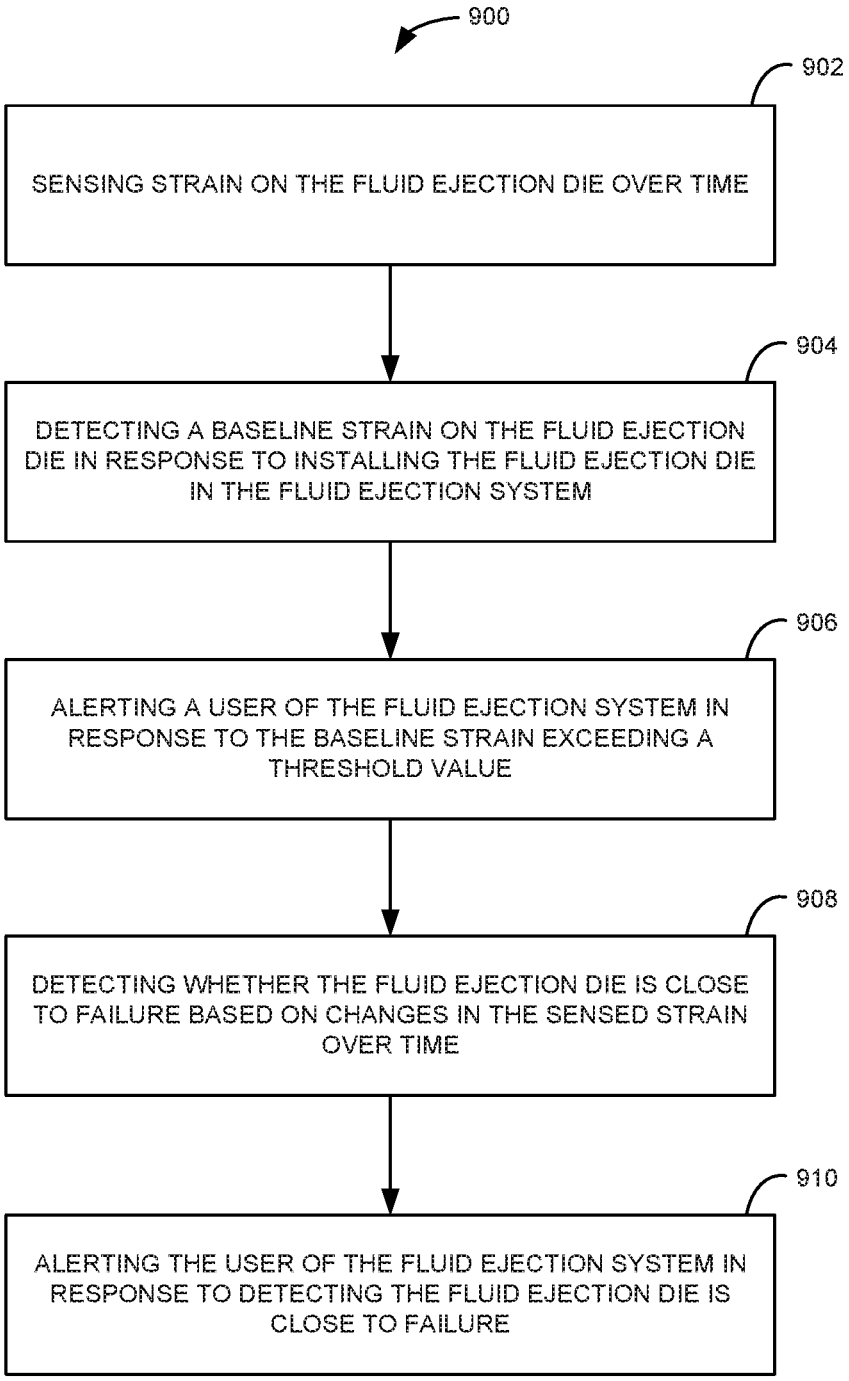
FIG. 9 is a flow diagram illustrating another example of a method for maintaining a fluid ejection system.

FIG. 9 is a flow diagram illustrating another example of a method 900 for maintaining a fluid ejection system. At 902, method 900 includes sensing strain on the fluid ejection die over time. At 904, method 900 includes detecting a baseline strain on the fluid ejection die in response to installing the fluid ejection die in the fluid ejection system. At 906, method 900 includes alerting a user of the fluid ejection system in response to the baseline strain exceeding a threshold value. At 908, method 900 includes detecting whether the fluid ejection die is close to failure based on changes in the sensed strain over time. At 910, method 900 includes alerting the user of the fluid ejection system in response to detecting the fluid ejection die is close to failure.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein. Therefore, it is intended that this disclosure be limited only by the claims and the equivalents thereof.

The invention claimed is:

1. A fluid ejection system comprising:

a fluid ejection die comprising at least one strain gauge sensor to sense strain;

a service station assembly to service the fluid ejection die; and a controller to receive the sensed strain from the at least one strain gauge sensor during servicing of the fluid ejection die and adjust or stop servicing of the fluid ejection die in response to the sensed strain exceeding a servicing threshold.

2. The fluid ejection system of claim 1, wherein the fluid ejection die comprises a plurality of strain gauge sensors, each of the plurality of strain gauge sensors to sense strain, and wherein the controller is to receive the sensed strain from each of the plurality of strain gauge sensors during servicing of the fluid ejection die.

3. The fluid ejection system of claim 1, wherein the controller is to receive a baseline sensed strain from the at least one strain gauge sensor in response to installing the fluid ejection die in the fluid ejection system and alert a user of the fluid ejection system in response to the baseline sensed strain exceeding a baseline threshold.

4. The fluid ejection system of claim 1, wherein the controller is to receive the sensed strain from the at least one strain gauge sensor over time, compare the sensed strain to a failure threshold indicating proximate failure of the fluid ejection die, and alert a user of the fluid ejection system in response to the sensed strain exceeding the failure threshold.

5. The fluid ejection system of claim 1, wherein the controller is to receive the sensed strain from the at least one strain gauge sensor during operation of the fluid ejection die, determine whether the fluid ejection die has impacted an object based on the sensed strain, and stop operation of the fluid ejection die in response to an impact.

6. The fluid ejection system of claim 5, wherein the object comprises a print media.

7. The fluid ejection system of claim 1, wherein the controller is to receive the sensed strain from the at least one strain gauge sensor during operation of the fluid ejection die, determine whether the fluid ejection die is vibrating based on the sensed strain, and adjust or stop operation of the fluid ejection die in response to vibration exceeding a vibration threshold.

8. The fluid ejection system of claim 1, wherein the service station assembly comprises a wiper to wipe the fluid ejection die, and wherein the controller is to receive the sensed strain from the at least one strain gauge sensor during wiping of the fluid ejection die and adjust or stop wiping of the fluid ejection die in response to the sensed strain exceeding the servicing threshold.

9. A fluid ejection system comprising:

a fluid ejection die comprising a plurality of strain gauge sensors, each of the plurality of strain gauge sensors to sense strain;

a service station assembly to service the fluid ejection die, the service station assembly comprising a servicing component; and a controller to receive the sensed strain from each of the plurality of strain gauge sensors during servicing of the fluid ejection die during which the servicing component comes into contact with the fluid ejection die and to calibrate the servicing component in response to the sensed strain from each of the plurality of strain gauge sensors.

10. The fluid ejection system of claim 9, wherein the fluid ejection die comprises a silicon die, and wherein each of the plurality of strain gauge sensors comprises a piezoelectric sensor element.

11. The fluid ejection system of claim 9, wherein each of the plurality of strain gauge sensors comprises four piezoelectric sensor elements in a Wheatstone bridge configuration.

12. The fluid ejection system of claim 9, wherein the controller is to receive the sensed strain from each of the plurality of strain gauge sensors during operation of the fluid ejection die, to determine whether the fluid ejection die has impacted an object, is vibrating, or is close to failure based on the sensed strain, and to alert a user of the fluid ejection system in response to an impact, vibration exceeding a vibration threshold, or determining the fluid ejection die is close to failure.

13. The fluid ejection system of claim 12, wherein the object comprises a print media and the failure comprises a cracked die failure.

14. The fluid ejection system of claim 9, wherein the servicing component comprises a wiper to wipe the fluid ejection die, and wherein the controller is to receive the sensed strain from each of the plurality of strain gauge sensors during wiping of the fluid ejection die during which the wiper comes into contact with the fluid ejection die and to calibrate the wiper in response to the sensed strain from each of the plurality of strain gauge sensors.

15. A method for maintaining a fluid ejection system, the method comprising:

sensing, during servicing of the fluid ejection system, strain on a fluid ejection die due to a servicing component, the strain sensed via at least one strain gauge sensor integrated within the fluid ejection die; and calibrating the servicing component based on the sensed strain.

16. The method of claim 15, further comprising:

stopping servicing of the fluid ejection system in response to the sensed strain exceeding a threshold.

17. The method of claim 15, wherein sensing strain on the fluid ejection die comprises sensing strain on the fluid ejection die via a plurality of strain gauge sensors integrated within the fluid ejection die.

18. The method of claim 15, wherein sensing strain on the fluid ejection die comprises sensing strain on the fluid ejection die during operation of the fluid ejection system, the method further comprising:

detecting whether the fluid ejection die has impacted an object based on the sensed strain;

detecting whether the fluid ejection die is vibrating based on the sensed strain; and stopping the operation of the fluid ejection system or alerting a user of the fluid ejection system in response to detecting an impact or detecting vibration exceeding a threshold.

19. The method of claim 15, wherein sensing strain on the fluid ejection die comprises sensing strain on the fluid ejection die over time, the method further comprising:

detecting a baseline strain on the fluid ejection die in response to installing the fluid ejection die in the fluid ejection system;

alerting a user of the fluid ejection system in response to the baseline strain exceeding a threshold value;

detecting whether the fluid ejection die is close to failure based on changes in the sensed strain over time; and alerting the user of the fluid ejection system in response to detecting the fluid ejection die is close to failure.

20. The method of claim 15, wherein the servicing component comprises a wiper to wipe the fluid ejection die, and wherein calibrating the servicing component comprises calibrating the wiper based on the sensed strain.

* * * * *